US006198461B1

(12) United States Patent
Chieusse et al.

(10) Patent No.: US 6,198,461 B1
(45) Date of Patent: Mar. 6, 2001

(54) ELASTICALLY DEFORMABLE ANTENNA REFLECTOR FOR A SPACECRAFT, AND SPACECRAFT INCLUDING SUCH A REFLECTOR

(75) Inventors: Nathalie Chieusse, Aubergenville; Christophe Prud'Hon, Rueil Malmaison; Guillaume Cautru, Poses; Christian Ducourthial, Cannes; Cyril Metz, Les Adrets de l'Esterel, all of (FR)

(73) Assignee: Societe Nationale Industrielle et Aerospatiale, Paris (FR)

( * ) Notice: Subject to any disclaimer, the term of this patent is extended or adjusted under 35 U.S.C. 154(b) by 0 days.

(21) Appl. No.: 09/345,750

(22) Filed: Jul. 1, 1999

(30) Foreign Application Priority Data

Jul. 2, 1998 (FR) ..... 98 08448

(51) Int. Cl.[7] ..... H01Q 15/20
(52) U.S. Cl. ..... 343/915; 343/881; 343/DIG. 2
(58) Field of Search ..... 343/878, 880, 343/881, 912, 914, 915, DIG. 2; H01Q 15/20

(56) References Cited

U.S. PATENT DOCUMENTS

| | | | | |
|---|---|---|---|---|
| 3,286,259 | | 11/1966 | Carman et al. | 343/18 |
| 3,521,290 | | 7/1970 | Bahiman et al. | 343/915 |
| 4,133,501 | | 1/1979 | Pentlicki | 244/173 |
| 4,315,265 | * | 2/1982 | Palmer et al. | 343/840 |
| 4,527,166 | * | 7/1985 | Luly | 343/840 |
| 4,899,167 | * | 2/1990 | Westphal | 343/915 |
| 4,926,181 | | 5/1990 | Stumm | 343/915 |
| 5,198,832 | * | 3/1993 | Higgins et al. | 343/915 |
| 5,296,044 | | 3/1994 | Harvey et al. | 136/245 |
| 5,574,472 | | 11/1996 | Robinson | 343/915 |
| 5,644,322 | | 7/1997 | Hayes et al. | 343/915 |

FOREIGN PATENT DOCUMENTS 0534110 3/1993 (EP) ..... H01Q/15/16

OTHER PUBLICATIONS

European Search Report dated Feb. 12, 1999.
L. R. D'Addario, "Microwave Technology Innovations in Orbiting VLBI," International Microwave Symposium Digest (MTT–S), Albuquerque, Jun. 1–5, 1992, vol. 3; Jun. 1, 1992, pp. 1375–1378, XP000344430.

* cited by examiner

*Primary Examiner*—Don Wong
*Assistant Examiner*—Shih-Chao Chen
(74) *Attorney, Agent, or Firm*—Stevens, Davis, Miller & Mosher, LLP

(57) ABSTRACT

An antenna reflector for a spacecraft includes a radial slot which facilitates stowage of the reflector in the spacecraft. When the reflector is in a folded position, opposing edges of the radial slot overlap in such a way that the reflector assumes an at least approximately conical shape, thereby allowing the reflector to be housed in a casing so as to be oriented vertically in line with the spacecraft.

7 Claims, 3 Drawing Sheets

ELASTICALLY DEFORMABLE ANTENNA REFLECTOR FOR A SPACECRAFT, AND SPACECRAFT INCLUDING SUCH A REFLECTOR

BACKGROUND OF THE INVENTION

1. Field of the Invention

The present invention relates to an elastically deformable antenna reflector for a spacecraft, such as an artificial satellite or space probe. It also relates to a spacecraft provided with at least one such reflector.

2. Description of Related Art

It is known that the items of equipment, such as the antennae, solar panels, etc, associated with a spacecraft have to be able to be folded in order to be able to be accommodated in a launch vehicle (rocket, shuttle) and to be deployed after ejection out of said launch vehicle, so as to take up their operational configuration.

It is known, moreover, that such equipment has already been produced in such a way that it is elastically deformable, this equipment then being able to take up either a deployed state, or a folded state, elastically deformed. For example, U.S. Pat. No. 3,521,290 describes an antenna reflector in a single piece of an elastically deformable material provided with a rigid central base to which are linked a plurality of radial ribs integral with the convex face of said reflector and elastically articulated to said central base. Thus, said antenna reflector can take up a position folded into the shape of a tulip, which does not risk entailing permanent deformation of said reflector, and the change from the folded position into the deployed position in the shape of a concave disk can be carried out under the action of the elastic energy stored during the folding of the antenna structure. Controllable retaining means, consisting of a belt with pyrotechnic bolts, surrounding said folded reflector and arranged on the side opposite said central base, are provided in order to hold said reflector and said radial ribs in folded position under stress.

U.S. Pat. No. 4,133,501, which describes a single-piece solar panel for a spacecraft produced in an elastically deformable way in order to be able to take up either a curved, folded position under stress for which said solar panel matches the convex outer surface of said spacecraft, or a flat, deployed position, clear of said outer surface, the change from the curved, folded position to the flat, deployed position being due to the elastic relaxation of said solar panel. In curved, folded position, the solar panel is held against the outer surface of said spacecraft by latches, carried by the spacecraft; and U.S. Pat. No. 4,926,181, which describes a single-piece antenna reflector of an elastically deformable material, which can be rolled into a cylindrical shape and held in this shape by clamps. An underlying pliable structure can be deployed, in order to serve as a support on which said reflector can unroll and take up its deployed, operating shape, under the action of its elastic relaxation.

U.S. Pat. No. 5,644 322, which describes an antenna reflector consisting of a central rigid base of large surface area, surrounded by a peripheral frustoconical ring, produced from an elastically deformable material. This prior document shows, moreover, that it is usual, for launching a spacecraft, to store it in an elongate casing, for example of cylindrical-conical shape, constituting, for example, the upper nose cone of the launch rocket, the reflector of the antenna or antennae of said spacecraft being arranged laterally with respect to the body of the latter in the peripheral space bounded between said body and said casing. By virtue of the structure of the reflector of the U.S. Pat. No. 5,644,322, the size of said reflector, within said cylindrical-conical casing, can be slightly reduced by temporarily elastically deforming said peripheral ring, said reflector then taking up the shape, at least approximately, of a bowl laterally enveloping said body. The reflector is kept in this bowl shape by a belt, loosening of which is controlled electrically and which surrounds said body and said reflector in the central region of said base, this belt folding said elastically deformable ring down onto said body, bearing on two diametrally opposite points of said ring. After ejection into space, said reflector can resume its operating position, by removal of said belt and elastic return of said peripheral ring to its elastically relaxed, stable, deployed position. It can easily be understood that, in such a device, the saving in size of said reflector in folded position, by comparison with the deployed position, is limited. This is, on the one hand, due to the large diameter of said rigid central base, the lateral compression of the reflector can be applied only to the peripheral ring, such that the saving in the lateral size is relatively small. On the other hand, this lateral compression not only exerts no reducing action on the longitudinal dimension of said reflector, but further increases said dimension due to the fact that it entails the straightening of the upper part of said peripheral ring outward. The longitudinal size of the reflector, in folded position, is thus greater than that of its deployed position. However, because of its dimensions, said reflector generally overshoots the upper longitudinal end of the body of said vehicle housed in the cylindrical part of the casing and has to be extended into the conical part thereof. This conical shape thus imposes a limitation on the diameter of the reflector. However, for obvious reasons of performance, it would be advantageous for the reflector to be able to have as large a diameter as necessary, and to match the convergent shape of the conical part of the casing.

U.S. Pat. No. 5,574,472 and EP-A-0 534 110 describe an antenna reflector in a single piece of an elastically deformable material, which can take up a bowl-shaped folded position by virtue of a controllably frangible tensile link arranged between two diametrally opposed points of the periphery of said reflector. It will be noted that, in this position folded into a bowl shape, the upper peripheral edge of the reflector, projecting outward with respect to the body of the spacecraft, is straightened outward and cannot therefore be housed in the conical part of the casing. Moreover, it will be noted that said tensile link constitutes an obstacle, or at least an impediment, in arranging the body of the spacecraft in the concave space of the reflector in folded position, and that the production of said reflector in a single piece allows neither precise control of the shape of the reflector in folded position, nor optimal enveloping of the body of the spacecraft.

SUMMARY OF THE INVENTION

The object of the present invention is to remedy these drawbacks, while making it possible to increase the dimensions of said antenna reflector and, if appropriate, the number of reflectors which is possible on the same spacecraft.

To this end, according to the invention, the antenna reflector for a spacecraft having to be stored in a casing of elongate shape along an axis, said reflector being in a single elastically deformable piece in such a way that:

- outside said casing, said reflector can take up a stable, deployed state without elastic stress, corresponding to its functional shape;

within said casing, said reflector can take up an elastically folded state in which it can be held by virtue of controllable retaining means; and the change by said reflector from its folded state to its deployed state being due to the release of the energy stored in said reflector when it is elastically folded in order to make it change from its deployed state to its folded state, is noteworthy:

in that said reflector includes a radial slot; and in that, in folded position of said reflector, the opposing edges of said radial slot overlap in such a way that said reflector takes up an at least approximately conical shape, allowing it to be housed in said casing, vertically in line with said spacecraft.

Hence, in accordance with the present invention and in contrast to the prior art, the reflector in folded position no longer exhibits the shape of a bowl, but that of a Chinese hat or of a lampshade, and is no longer housed laterally with respect to said spacecraft, but above it. In particular, when said casing exhibits a cylindrical-conical shape, said reflector in folded state can be arranged in the conical part of said casing. It results therefrom, by virtue of the present invention, that it is possible:

to increase the dimensions of said reflector;

to increase the number of reflectors stored;

to increase the accommodation capacity of said casing;

better to control the vibration of said reflector in folded position;

better to control the shape of said reflector in folded position;

to use controllable retaining mechanisms known for other uses.

It is preferable, in order to facilitate the shaping of said reflector in its folded position, that said reflector include a central cutout, into which said radial slot opens out.

In the case in which an articulated radial arm links said reflector to said spacecraft, it is advantageous for said radial slot to be at least substantially in the extension of said arm.

Because of said central cutout, it may be advantageous to off-center the base for linking between said reflector and said arm.

Controllable retaining means are advantageously provided in order to keep the edges of said radial slot together, in the overlapping position.

The present invention also relates to a spacecraft having to be stored in a casing of elongate shape along an axis, and including an antenna reflector in a single elastically deformable piece such that:

outside said casing, said reflector can take up a stable, deployed state without elastic stress, corresponding to its functional shape;

within said casing, said reflector can take up an elastically folded state in which it can be held by virtue of controllable retaining means; and the change by said reflector from its folded state to its deployed state being due to the release of the energy stored in said reflector when it is elastically folded in order to make it change from its deployed state to its folded state.

According to the invention, such a spacecraft is noteworthy:

in that said reflector includes a radial slot; and in that, in folded position of said reflector, the opposing edges of said radial slot overlap in such a way that said reflector takes up an at least approximately conical shape, allowing it to be housed in said casing, vertically in line with said spacecraft.

The spacecraft in accordance with the present invention may include at least one supplementary antenna reflector similar to said antenna reflector and said antenna reflectors, folded to their at least approximately conical shape, may be partially nested one inside the another and arranged vertically in line with said spacecraft, in order to be able to be housed in the conical part of said casing.

BRIEF DESCRIPTION OF THE DRAWINGS

The figures of the attached drawing will give a good understanding of how the invention can be produced. In these figures, identical references designate similar elements.

DESCRIPTION OF THE PREFERRED EMBODIMENTS

Figure 1:
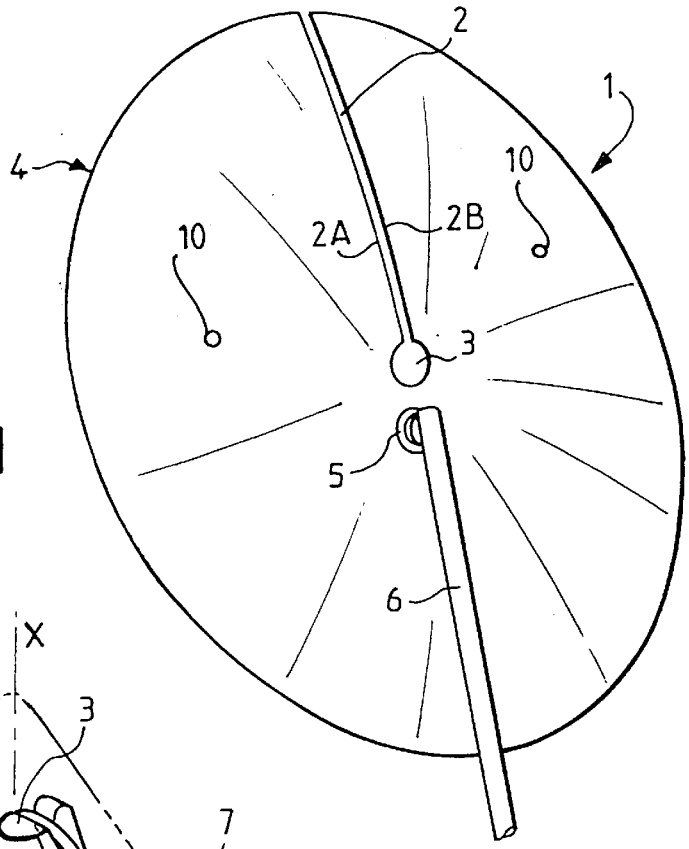
FIG. 1 is a view in diagrammatic perspective, from the rear, of an exemplary embodiment of the antenna reflector in accordance with the present invention, in deployed position.

The antenna reflector 1, in accordance with the present invention and illustrated diagrammatically in FIG. 1, exhibits the shape, at least approximately, of a concave disk provided with a radial slot 2 and with a central cutout 3, circular for example. The opposing edges 2A and 2B of the radial slot 2 open out, at one end, into said central cutout 3 and, at the other end, cut the peripheral contour 4 of said reflector.

The reflector 1 is produced from an elastically deformable material, for example as a fabric of carbon fibers. If appropriate, stiffening rings (not represented) are arranged on the convex rear face of said reflector 1.

Off-center with respect to the reflector 1, a rigid base 5 is provided, linked on the rear side—that is to say on the convex side of said reflector—to a linking arm 6, the end of which opposite said base 5 is intended to be articulated, in a way which is known and not represented in FIG. 1 (but is visible in FIG. 5) to the body of a spacecraft. In the example represented in FIG. 1, the linking arm 6 is radial and is in the extension of the radial slot 2, when the reflector 1 is deployed.

Figure 2:
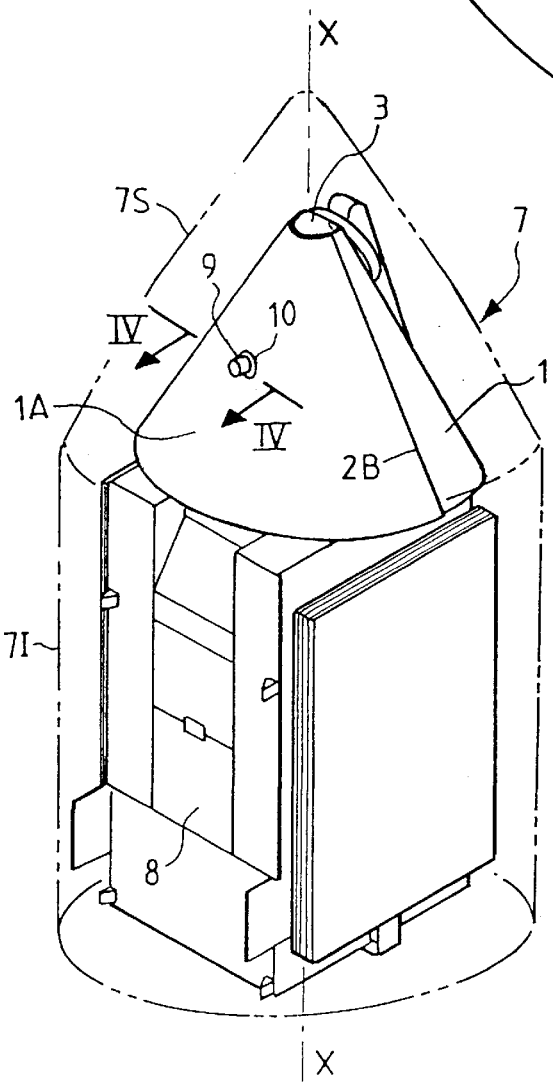
FIG. 2 diagrammatically shows the reflector in accordance with FIG. 1 arranged above a satellite, under the nose cone of a launcher.
Figure 3:
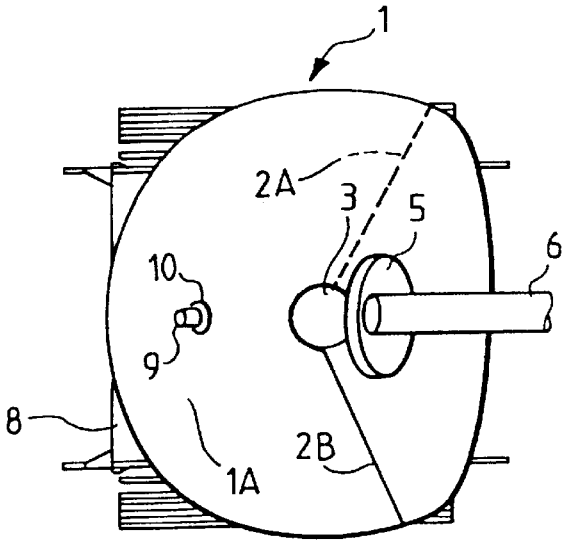
FIG. 3 is a top view of the reflector of FIG. 2.

Thus, as FIGS. 2 and 3 show, the reflector 1 can take up a position folded into the shape of a lampshade or a Chinese hat, in which the edges 2A and 2B of the slot 2 overlap, entailing the sectors 1A and lB of said reflector 1 being superimposed.

As FIG. 2 diagrammatically illustrates, the reflector 1 can be stored in the conical part 7S of an elongate cylindrical-conical casing 7 with longitudinal axis X—X, for example the nose cone of a space launcher, the spacecraft 8 with which said reflector 1 is associated being arranged in the cylindrical part 71 of said casing 7. As is usual (not visible in FIG. 2 but visible in FIG. 5), the reflector 1 is linked to said spacecraft 8 by the arm 6, articulated to the lower part of said spacecraft. It will be noted that it is possible to set the overlap of the edges 2A and 2B of the reflector 1, on the basis of the diameter of the nose cone 7 and of the transverse dimensions of the spacecraft 8.

Figure 4A:
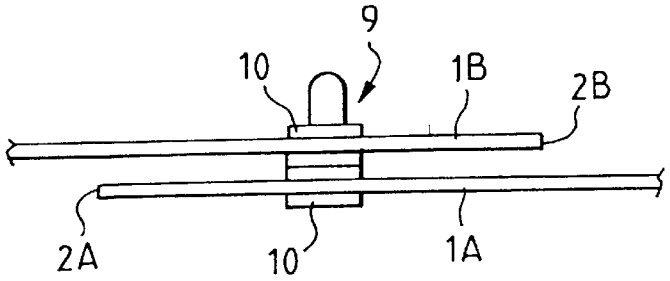
FIGS. 4A and 4B illustrate, in locked and unlocked position respectively, a device for retaining said reflector of FIGS. 1 to 3 in folded position, along the line IV—IV of FIG. 2.

In the folded storage position of FIG. 2, the reflector 1 is, moreover, held by at least one independent pyrotechnic stud 9, passing through eyelets 10 provided in the overlapping sectors 1A and 1B of the reflector 1 (see FIG. 4A).

Figure 4B:
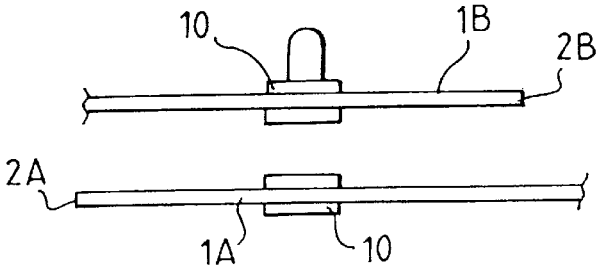

Hence, during the launch of the spacecraft, the reflector 1 is in the conical part 7S of the nose cone 7, above the spacecraft 8, as represented in FIG. 2, held rigidly in its folded shape by the pyrotechnic stud 9. After said nose cone 7 is jettisoned and the spacecraft 8 is ejected, the pyrotechnic stud 9 is activated and it releases the sectors 1A and 1B of the reflector (see FIG. 4B). Next, the reflector 1 relaxes so as spontaneously to take up its deployed state of FIG. 1, the arm 6 tilting (in a way which is known and not represented) so as to free said reflector from the body of the spacecraft 8.

Figure 5:
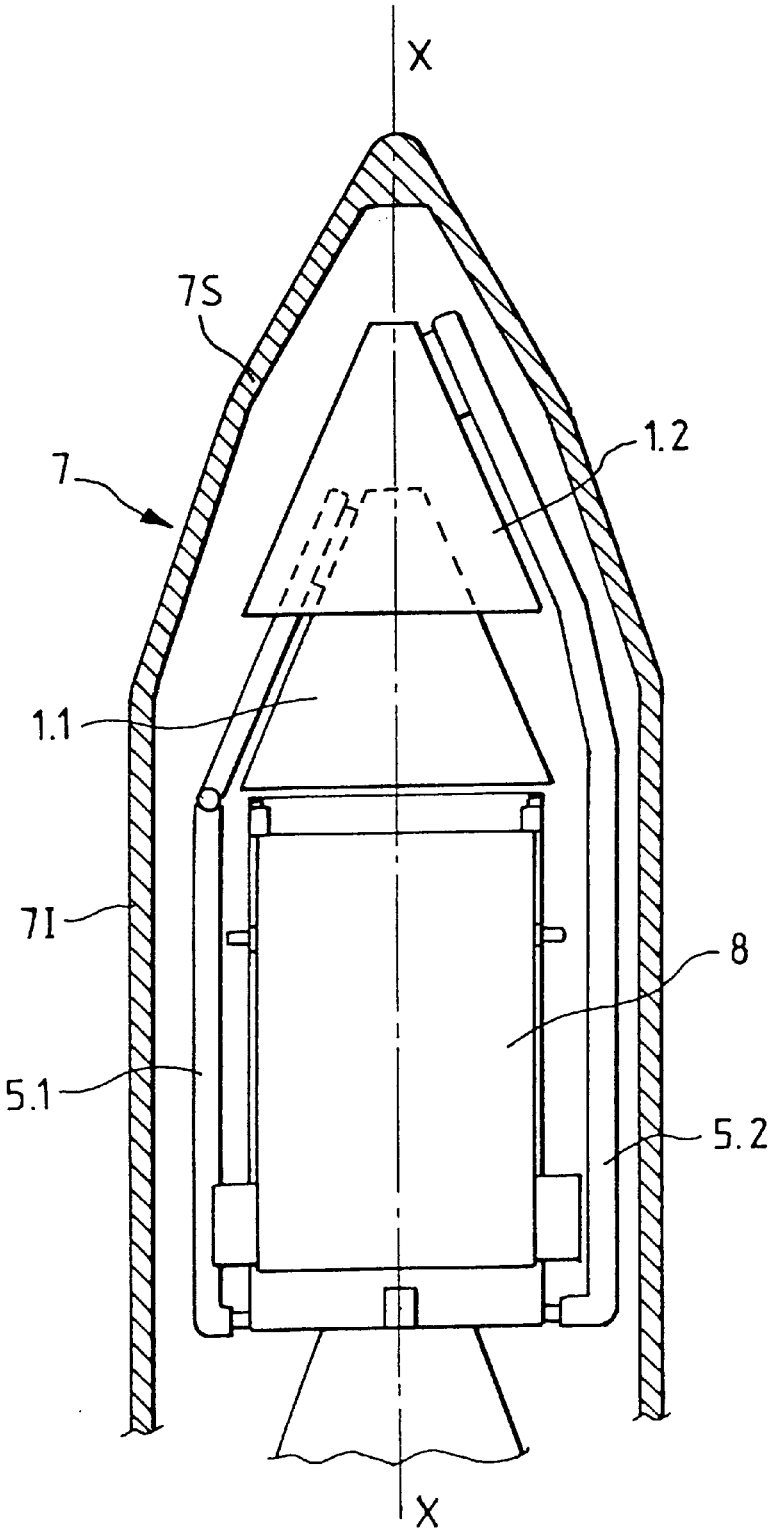
FIG. 5 illustrates the storage, under the nose cone of a launcher, of two antenna reflectors in accordance with the present invention.

In FIG. 5, the storage of two reflectors 1 has been illustrated, which are designated respectively by the references 1.1 and 1.2, above the spacecraft body 8. These two reflectors 1.1 and 1.2 are partially nested one inside the other and are housed in the conical part 7S of the casing 7. Such an arrangement entails the appropriate shaping of the linking arms 5 of said reflectors 1.1 and 1.2 (designated respectively by the references 5.1 and 5.2).

What is claimed is:

1. An antenna reflector for a spacecraft, said reflector capable of being stored in a casing of elongate shape along an axis (X—X), said reflector comprising a single elastically deformable piece wherein:

outside said casing, said reflector is present in a stable, deployed state without elastic stress, corresponding to said reflector's functional shape;

within said casing, said reflector is present in an elastically folded state in which said reflector is secured by virtue of controllable retaining means; and the change of said reflector from said folded state to said deployed state is due to the release of the energy stored in said reflector when said reflector is elastically folded in order to make said reflector change from said deployed state to said folded state, wherein:

said reflector comprises a radial slot; and in said folded state of said reflector opposing edges of said radial slot overlap in such a way that said reflector assumes an at least approximately conical shape, allowing said reflector to be housed in said casing so as to be oriented vertically in line with said spacecraft.

2. The antenna reflector according to claim 1, further comprising a central cutout into which said radial slot opens out.

3. The antenna reflector according to claim 1, further comprising an articulated radial arm which links said reflector to said spacecraft, wherein said radial slot is disposed so as to be at least substantially within the extension of said arm.

4. The antenna reflector according to claim 3, further comprising a base which links said reflector to said arm, said base being disposed off-center with respect to said arm.

5. The antenna reflector according to claim 1, wherein said controllable retaining means keeps said edges of said radial slot together, in an overlapping position.

6. A spacecraft capable of being stored in a casing of elongate shape along an axis (X—X), said spacecraft comprising an antenna reflector comprising a single elastically deformable piece wherein:

outside said casing, said reflector is present in a stable, deployed state without elastic stress, corresponding to said reflector's functional shape;

within said casing, said reflector is present in an elastically folded state in which said reflector is secured by virtue of controllable retaining means; and the change of said reflector from said folded state to said deployed state is due to the release of the energy stored in said reflector when said reflector is elastically folded in order to make said reflector change from said deployed state to said folded state, wherein:

said reflector comprises a radial slot; and in said folded state of said reflector, opposing edges of said radial slot overlap in such a way that said reflector assumes an at least approximately conical shape, allowing said reflector to be housed in said casing so as to be oriented vertically in line with said spacecraft.

7. The spacecraft according to claim 6, further comprising at least one supplementary antenna reflector wherein said antenna reflector and said at least one supplementary antenna reflector, folded to their at least approximately conical shape, partially nest one inside the other and are oriented vertically in line with said spacecraft.

* * * * *

UNITED STATES PATENT AND TRADEMARK OFFICE

CERTIFICATE OF CORRECTION

PATENT NO. :6,198,461 B1
DATED :March 6, 2001
INVENTOR(S) :Nathalie Chieusse, et al.

It is certified that error appears in the above-identified patent and that said Letters Patent is hereby corrected as shown below:

The assignee's name should be " AEROSPATIALE SOCIETE NATIONALE INDUSTRIELLE" not SOCIETE NATIONALE INDUSTRIELLE ET AEROSPATIALE.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*